United States Patent [19]

Rebischung

[11] Patent Number: 4,866,913

[45] Date of Patent: Sep. 19, 1989

[54] METHOD AND MACHINE FOR CLOSING CONTAINERS, PARTICULARLY POTS AND SMALL TRAYS

[75] Inventor: Robert A. Rebischung, Selestat, France

[73] Assignee: Societe Alsacienne d'Aluminum, Saint Julien en Genevois, France

[21] Appl. No.: 194,290

[22] Filed: May 16, 1988

[30] Foreign Application Priority Data

May 18, 1987 [FR] France ..... 87 06911

[51] Int. Cl.[4] ..... B65B 7/28; B67B 3/00

[52] U.S. Cl. ..... 53/478; 53/296; 53/306; 53/329; 53/487; 156/69

[58] Field of Search ..... 53/141, 281, 282, 290, 53/296, 297, 298, 306, 310, 312, 329, 372, 393, 471, 478, 485, 487; 156/69, 230, 234, 238, 240, 249

[56] References Cited

U.S. PATENT DOCUMENTS

| | | | |
|---|---|---|---|
| 3,432,376 | 3/1969 | Reed et al. | 156/234 |
| 4,287,702 | 12/1981 | Corbic | 53/425 |
| 4,475,969 | 10/1984 | Reed | 156/152 |
| 4,575,987 | 3/1986 | Fortuna | 53/478 |
| 4,643,789 | 2/1987 | Parker et al. | 156/238 X |

FOREIGN PATENT DOCUMENTS 2807025 8/1979 Fed. Rep. of Germany .

*Primary Examiner*—Robert L. Spruill
*Assistant Examiner*—Beth Bianca
*Attorney, Agent, or Firm*—Finnegan, Henderson, Farabow, Garrett & Dunner

[57] ABSTRACT

The method and machine according to the invention allow the closing of containers, particularly pots and small trays for food products. The method consists successively in separably fixing a strip of closure material (1) on a support strip (2), the closure material strip comprising pre-cutouts (4) defining lids (5) for closing the containers (6), separating from the support strip (2) the portion (10) of the closure material strip (1) which is situated externally of the lids (5), fixing a lid (5) on each of the containers (6) and separating the support strip (2) from each of the lids (5) fixed on the containers (6). The machine according to the invention comprises a supply station (7) for delivering a complex formed by a closure material strip (1) fixed separably to a support strip (2), a separation station (9) for separating from the support strip (2) the portion (10) of the strip (1), and a recovery station (12) for receiving the support strip (2).

15 Claims, 1 Drawing Sheet

METHOD AND MACHINE FOR CLOSING CONTAINERS, PARTICULARLY POTS AND SMALL TRAYS

Figure 1:
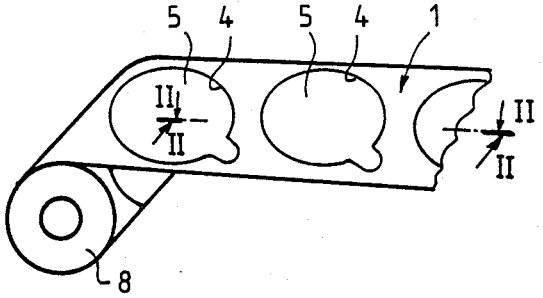

The present invention relates to a method and machine for closing containers, particularly pots and small trays for food products.

Closing food product containers is a delicate operation which requires complex and costly machines as well as qualified staff.

The present invention proposes facilitating this operating while further reducing the cost price and, for this, it provides a method for closing containers which is essentially characterized in that it consists successively in separably fixing a strip of closure material to a support strip, the closure material strip comprising pre-cutouts defining lids for closing the containers, separating from the support strip the portion of the closure material strip which is situated outside the lids, fixing a lid on each of the containers and separating the support strip from each of the lids fixed to the containers.

The steps in this method are few and easy to carry out, which results in an appreciable reduction in the investments to be made, as well as extensive automation.

When batches of containers of different dimensions in the closure material strip after this latter has been fixed to the support strip.

The complex formed by the closure material strip and the support strip may thus be used whatever the dimensions of the containers to be closed. It is in fact sufficient to use the tools required for forming the cutouts having the desired dimensions and shapes.

The complex whose closure material strip is pre-cutout may advantageously be reeled up prior to separation of the portion of the closure material strip which is situated outside the lids. Reeling up thereof facilitates storage, transport and subsequent use.

In an embodiment of the method of the invention having given excellent results, separation of the portion of the closure material strip which is situated outside the lids, fixing of the lids on the containers and separation of the support strip are carried out continuously.

To facilitate handling and re-use, it is further desirable to reel up the portion of the closure material strip which is situated outside the lids and the support strip as they are separated.

When the containers to be closed are made from a thermoplastic material or have a thermoplastic heat sealing zone or not on their face intended to receive a lid, the method of the invention recommends pressing the lids against the containers while heating them. It further recommends heating the lids by induction, prreferably by means of medium or high frequency induction, when the closure material comprises at least one metal, in particular aluminum, foil or coating.

In accordance with the invention, it is further desirable to fix the strip of closure material on a porous material support strip by means of an adhesive capable of becoming fluid under the effect of heat.

Because of its porosity, the support strip may absorb the adhesive material when it becomes fluid. Thus, it prevents the adhesive material from remaining on the lids after they have been positioned on the containers.

Furthermore, the porous material may be paper or cardboard, whereas the adhesive material may be a "hot melt" or a wax.

As for the machine of the invention, it is essentially characterized in that it comprises a supply station for delivering a complex formed by a strip of closure material fixed separably to a support strip and comprising cutouts defining lids for closing the containers, a separation station provided downstream of the supply station for separating from the support strip the portion of the closure material strip which is situated outside the lids, a sealing station provided downstream of the separation station for applying the lids to the containers and separating them from the support strip and a recovery station provided downstream of the sealing station for receiving the support strip.

Figure 2:
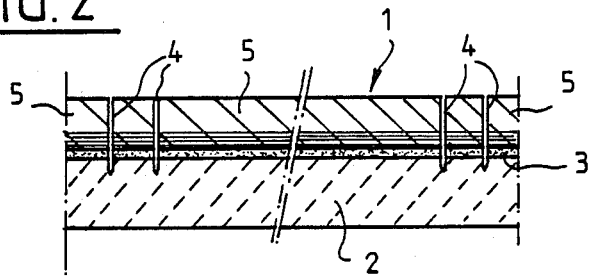
Figure 3:
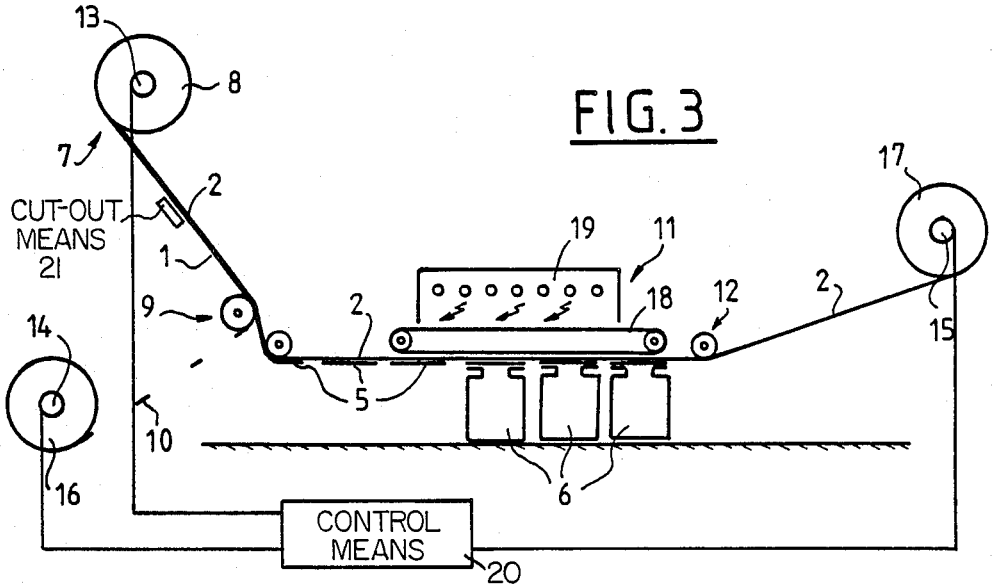

One embodiment of the present invention will be described hereafter by way of example, with reference to the accompanying drawings in which:

FIG. 1 is a schematical perspective view of a reel formed with a complex in accordance with the invention, FIG. 2 is an enlarged schematical sectional view through line II—II of FIG. 1, and FIG. 3 is a schematical elevational view of a machine of the invention.

Referring to FIGS. 1 and 2, the complex comprises a closure material strip 1 fixed to a support strip 2 by means of a wax 3 or an equivalent adhesive material adapted to allow these two strips to be separated by peeling.

The closure material strip 1 comprises pre-cutouts 4 defining lids 5 for closing the containers 6 in which food or other products are packed, these containers being made from a thermoplastic material or comprising a thermplastic heat sealing zone or not on their face intended to receive the lid for closing them.

Strip 1, in the example shown, is of the type comprising a thermoplastic material layer on its face intended to be fixed to the containers (namely the one opposite the support strip 2) and at least one metal, for example aluminium, foil or deposit. As for the support strip 2, it is made from a porous material, for example paper or cardboard, for absorbing the adhesive material 3 during heat sealing.

It will be noted here that the closure material strip 1 may have a thickness of the order of 7 to 80$\mu$ ($7.10^{-6}$ to $8.10^{-5}$m) whereas the support strip 2 may have a thickness of about 30 to 300$\mu$ ($3.10^{-5}$ to $3.10^{-4}$m) and the wax may form a layer of about 3 to 20$\mu$ ($3.10^{-6}$ to $2.10^{-5}$m).

It will also be noted that fixing strip 1 on strip 2 may be carried out continuously in a way known per se and that the pre-cutouts 4 may be formed in strip 1 either before or after it is fixed to strip 2 by a suitable cut out means 21.

The machine shown in FIG. 3 has been designed for fixing lids 5 to containers 6.

It comprises first of all a supply station 7 adapted for receiving a reel 8 containing the complex resulting from fixing strips 1 and 2 one against the other, a separation station 9 situated downstream of the supply station 7 and in which the portion 10 of strip 1 which is situated outside lids 5 may be separated from the support strip 2, a sealing station 11 provided downstream of the separation station 9 and in which the lids 5 remaining on the support strip 2 may be fixed to the containers 6 and a recovery station 12 provided downstream of the sealing station 11 and in which the support strip 2 may be removed from the closed containers.

The supply station 7 comprises a spindle 13 for receiving reel 8 whereas the separation 9 and recovery 12 stations comprise respectively a spindle 14 for reeling up portions 10 of strip 1 and a spindle 15 for reeling up the support strip 2. Conventional control means 20 are of course provided for rotating spindles 13, 14 and 15 so as to provide in synchronism unwinding of the complex forming reel 8, the formation of a reel 16 with portion 10 of strip 1 and the formation of a reel 17 with the support strip 2.

As for the sealing station 11, it comprises conventional means 18 for pressing the lids 5 against the containers to be closed 6 and medium or high frequency induction heating means 19 for melting the layer of thermoplastic material coating the lids as well as for making the wax layer 3 fluid and causing this latter to be absorbed by strip 2.

The procedure for closing containers 6 will now be briefly described.

First of all a reel 8 is fitted on spindle 13 so that the support strip 2 is turned upwardly.

Then the complex formed by strips 1 and 2 is unwound over a sufficient length for introducing portion 10 of strip 1 into the separation station 9 and for beginning winding up thereof on spindle 14.

Finally, strip 2 is introduced into the sealing station 11, then into the recovery station 12 so as to being winding up thereof on spindle 15.

It only remains now to actuate the machine for sealing the lids on the containers. It will be noted here that the containers may advantageously be deposited on a conveyor (not shown) provided for transporting them in synchronism with the support strip 2, and that appropriate register means are normally provided for suitably positioning the lids on the containers to be closed.

I claim:

1. A method for closing containers comprising successively providing a complex of a separable strip of closure material fixed on a support strip, the closure material strip containing pre-cutouts of the lids for closing the containers, separating from the support strip that portion of the closure material strip which is situated externally of the lids, fixing a lid on each of the containers and then separating the support strip from each of lids fixed on the containers.

2. The method of claim 1, wherein the pre cutouts are formed in the closure material strip after the closure material strip is fixed on the support strip.

3. The method of claim 1, wherein the pre-cutouts are formed in the closure material strip before the closure material strip is fixed on the support strip.

4. The method of claim 1, wherein the complex of the precutout closure material strip and the support strip before separation of said portion of the closure material strip is provided in the form of a reel.

5. The method of claim 4, which comprises continuously separating said portion of the closure material strip which is situated outside the lids, fixing the lids on the containers and separating the support strip.

6. The method of claim 5, which comprises reeling up said portion of the closure material strip which is situated outside the lids and the support strip as they are separated.

7. The method of claim 1 for closing containers having a thermoplastic heat sealing zone on their face intended to receive the lid, which comprises heating the lids and the support strip while pressing the lids against the containers.

8. The method of claim 7, wherein the lids and the support strip are heated by induction when the closure material comprises at least one metal foil or metal coating.

9. The method of claim 8, wherein the closure material comprises at least one aluminum foil or coating.

10. The method of claim 1, which comprises fixing the closure material strip to the support strip with an adhesive material which becomes fluid under the effect of heat.

11. The method of claim 10 wherein the support strip is paper or cardboard and the adhesive material is a wax.

12. A machine for closing containers, comprising a supply station for delivering a complex of a closure material strip fixed separably to a support strip said closure material strip having pre-cutouts defining lids for closing the containers, a separation station for separating from the support strip that portion of the closure material strip which is situated outside the lids, a sealing station downstream of the separation station for applying the lids to the containers and separating them from the support strip and a receiving station downstream of the sealing station for receiving the support strip.

13. The machine of claim 12, wherein the supply station comprises a spindle for unreeling the complex, the separation station comprises a spindle for reeling up said portion of the closure material strip and, the receiving station comprises a spindle for reeling up the support strip and, control means for rotating the spindles in synchronism.

14. The machine of claim 12, wherein the sealing station includes heating means and pressing means for pressing the lids against the containers to be closed.

15. The machine of claim 14, wherein the heating means are induction heating means.

* * * * *